US005220313A

United States Patent [19]

Kumazawa et al.

[11] Patent Number: 5,220,313

[45] Date of Patent: Jun. 15, 1993

[54] DEVICE FOR DRIVING A LIQUID CRYSTAL DISPLAY DEVICE

[75] Inventors: Seiji Kumazawa; Shizuo Manako, both of Nara, Japan

[73] Assignee: Sharp Kabushiki Kaisha, Osaka, Japan

[21] Appl. No.: 839,703

[22] Filed: Feb. 24, 1992

Related U.S. Application Data

[63] Continuation of Ser. No. 532,330, Jun. 5, 1990, abandoned.

[30] Foreign Application Priority Data

Jun. 13, 1989 [JP] Japan ..... 1-150957

[51] Int. Cl.[5] ..... G09G 3/36

[52] U.S. Cl. ..... 340/765; 340/784; 340/811

[58] Field of Search ..... 340/765, 784, 811, 812, 340/813, 814

[56] References Cited

U.S. PATENT DOCUMENTS 4,737,782 4/1988 Fukuma et al. ..... 340/765

4,909,607 3/1990 Ross ..... 340/805

*Primary Examiner*—Jeffery A. Brier

*Attorney, Agent, or Firm*—Nixon & Vanderhye

[57] ABSTRACT

A device for driving a liquid crystal display device, including, a segment signal output circuit for supplying segment signals to segment electrodes of the liquid crystal display device, a level of each of the segment signals being changed according to a level of corresponding one of data signals received by the segment signal output circuit, and a back plate signal output circuit for supplying a back plate signal having a predetermined level to back plate electrodes of the liquid crystal display device in succession. The segment signal output circuit is adapted to shift a level of each of the segment signals, for a short period of time at least shortly prior to change of level of corresponding one of the data signals, to such a value that electric charges charged up in a corresponding liquid crystal cell are discharged within the short period of time.

4 Claims, 3 Drawing Sheets

DEVICE FOR DRIVING A LIQUID CRYSTAL DISPLAY DEVICE

This is a continuation of application Ser. No. 07/532,330, filed Jun. 5, 1990, now abandoned.

BACKGROUND OF THE INVENTION

1. Field of the Invention

The present invention concerns a device for driving a liquid crystal display device including a plurality of common electrodes and a plurality of segment electrodes which intersect with the common electrodes.

2. Description of the Related Art

In general, a device for driving a liquid crystal display device comprises a segment signal output circuit for supplying segment signals to segment electrodes, and a back plate signal output circuit for supplying a back plate signal to back plate electrodes or common electrodes in succession.

An output buffer of such a segment signal output circuit has two pairs of two transistors connected in series for each segment electrode.

The reason is because if the output buffer is constructed to have only one pair of two transistors connected in series for each segment electrode, the waveform of the segment signal outputted therefrom is dulled thereby deteriorating displaying quality of an image as explained in detail later.

SUMMARY OF THE INVENTION

The object of the present invention is to provide a device for driving a liquid crystal display device, which can supply a segment signal to a segment electrode through an output buffer having one pair of two transistors connected in series for each segment electrode without deteriorating displaying quality of an image.

The object of the present invention can be achieved by a device for driving a liquid crystal display device, comprising:

segment signal supplying means for supplying segment signals to segment electrodes of said liquid crystal display device, a level of each of said segment signals being changed according to a level of corresponding one of data signals received by said segment signal supplying means; and back plate signal supplying means for supplying a back plate signal having a predetermined level to back plate electrodes of said liquid crystal display device in succession;

wherein said segment signal supplying means is adapted to shift a level of each of said segment signals, for a short period of time at least shortly prior to change of level of corresponding one of said data signals, to such a value that electric charges charged up in a corresponding liquid crystal cell are discharged within said short period of time.

Advantages of the above-mentioned device are that the size and manufacturing cost can be reduced compared with a conventional device because an area required for forming the output buffer of the segment signal output circuit on an integrated-circuit substrate is small.

Further objects and advantages of the present invention will be apparent from the following description, reference being had to the accompanying drawings wherein preferred embodiment of the present invention is clearly shown.

DESCRIPTION OF THE PREFERRED EMBODIMENT

Figure 1:
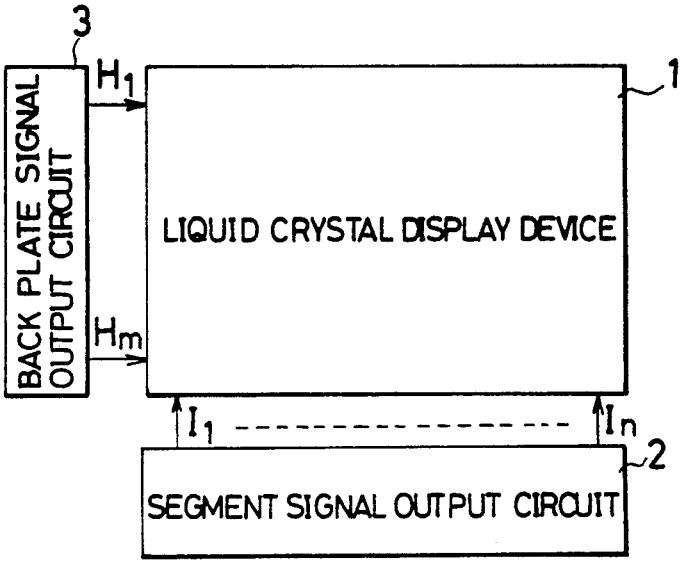
FIG. 1 is a view showing connection between a liquid crystal display device and a device for driving the liquid crystal display device.

In FIG. 1, there are shown a liquid crystal display device 1, a segment signal output circuit 2, and a back plate signal output circuit 3.

The segment signal output circuit 2 supplies segment signals I1 through In to n segment electrodes of the liquid crystal display device 1. The back plate signal output circuit 3 supplies back plate signals H1 through Hm to m back plate electrodes of the liquid crystal display device 1.

Prior to describing an embodiment of the present invention, a device for driving a liquid crystal display device, whose segment signal output circuit has an output buffer having two pairs of two transistors connected in series for each segment electrode, will be explained below referring to FIGS. 2 to 5.

Figure 2:
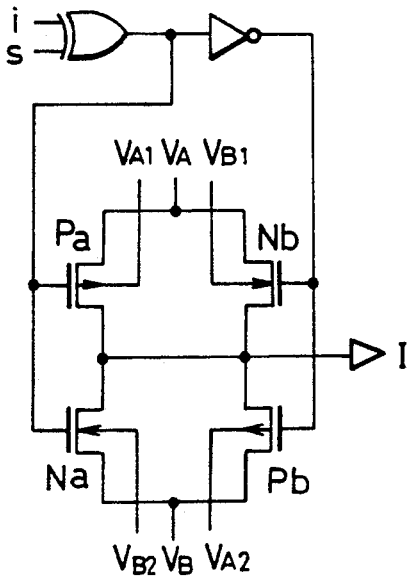
FIG. 2 is a circuit diagram showing a part of a segment signal output circuit having an output buffer which has two pairs of two transistors connected in series for one segment electrode.
Figure 3:
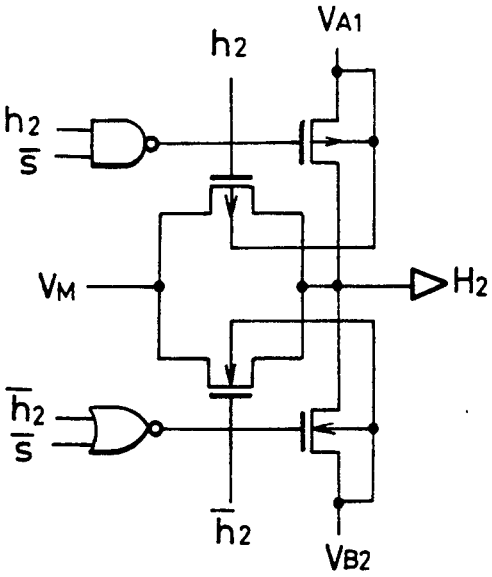
FIG. 3 is a circuit diagram showing a part of a back plate signal output circuit used for the liquid crystal display device together with the segment signal output circuit of FIG. 2.

FIG. 2 shows a part of such a segment signal output circuit, which is for supplying a segment signal I to one arbitrary segment electrode, and FIG. 3 shows a part of a back plate signal output circuit, which is for supplying a back plate signal H2 to the second back plate electrode.

Figure 4:
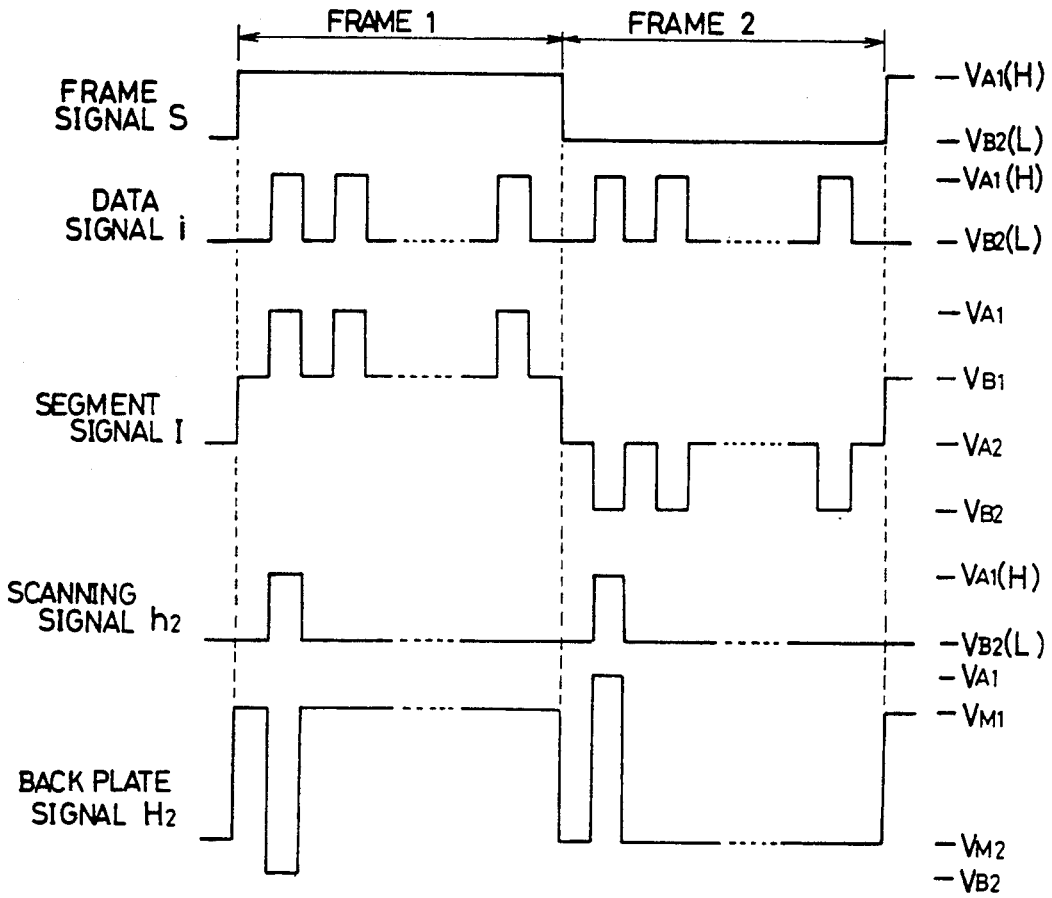
FIG. 4 is a time table showing various signals supplied to the circuits of FIGS. 2 and 3.

These circuits of FIGS. 2 and 3 receive a frame signal S, a data signal i, a scanning signal h2 shown in a time table of FIG. 4 as well as a negation $\overline{S}$ of the frame signal S, a negation $\overline{h2}$ the scanning signal h2 and a voltage VM, and output the segment signal I and the back plate signal H2.

As shown in FIG. 2, potentials of sources of a p-type transistor Pa and an n-type transistor Nb equal to VA, and those of an n-type transistor Na and a p-type transistor Pb equal to VB.

During FRAME 1 in which the frame signal S is at a high level of VA1, the potential VA is kept at VA1 and the potential VB is kept at VB1.

During FRAME 2 in which the frame signal S is at a low level of VB2, the potential VA is kept at VA2, and the potential VB is kept at VB2.

The voltage VM is kept at a level of VM1 during FRAME 1, and kept at a level of VM2 during FRAME 2.

When the data signal i rises to the high level of VA1 during FRAME 1, the transistors Pa and Nb are turned on to change the level of the segment signal I to VA1, thereby putting on a corresponding liquid crystal cell.

While, when the data signal i falls to the low level of VB2 during FRAME 1, the transistors Na and Pb are turned on to change the level of the segment signal I to VB1, thereby putting out the corresponding liquid crystal cell.

When the data signal i rises to the high level of VA1 during FRAME 2, the transistors Na and Pb are turned on to change the level of the segment signal I to VB2, thereby putting on the corresponding liquid crystal cell.

While, when the data signal i falls to the low level of VB2 during FRAME 2, the transistors Pa and Nb are turned on to change the level of the segment signal I to VA2, thereby putting out the corresponding liquid crystal cell.

In FIG. 2, if the transistors Nb and Pb are removed, that is, if the output buffer is constructed by the transistors Pa and Na only, the transistor Na is subjected to a back gate bias when it is turned on (when the level of the data signal i is changed from VA1 to VB2) during FRAME 1 because its source potential becomes VB1 higher than its substrate potential VB2 whereby a resistance of the transistor Na on "on" state is increased.

Similarly, the transistor Pa is subjected to a back gate bias when it is turned on (when the level of the data signal i is changed from VA1 to VB2) during FRAME 2 because its source potential becomes VA2 lower than its substrate potential VA1 whereby a resistance of the transistor Pa on "on" state is increased.

Figure 5:
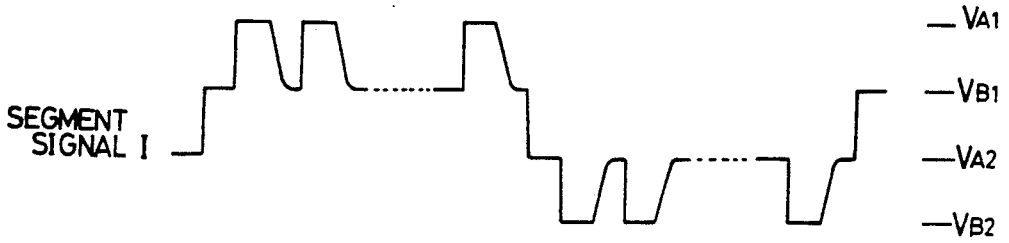
FIG. 5 is a view showing a waveform of a segment signal which has been dulled.

In consequence, a period of time required for charging the corresponding liquid crystal cell with electric charges or discharging electric charges charged up in the corresponding liquid crystal cell is increased whereby the waveform of the segment signal I is dulled as shown in FIG. 5. This causes the loss of sharpness of an image displayed on the display device.

The transistors Nb and Pb are added in order to prevent the waveform of the segment signal I from being dulled.

By the provision of the transistors Nb and Pb, an output impedance of the segment signal output circuit can be kept within a small value sufficient for charging the liquid crystal cell with electric charges or discharging electric charges charged up in the liquid crystal cell in a short period of time.

The device for driving a liquid crystal display device according to the present invention will now be described below.

Figure 6:
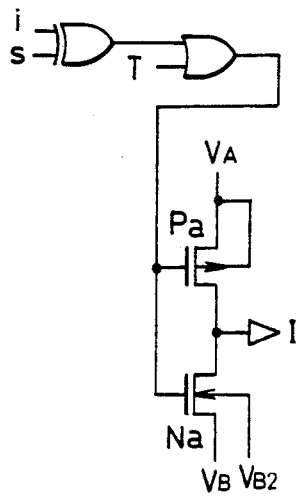
FIG. 6 is a circuit diagram showing a part of a segment signal output circuit of a device of an embodiment according to the present invention.

FIG. 6 shows a part of a segment signal output circuit of the device according to the present invention, which is for supplying a segment signal I to an arbitrary segment electrode.

A p-type transistor Pa and an n-type transistor Na are CMOS transistors obtained by forming an n-type well as a substrate of the transistor Pa in a p-type substrate.

The potential of the substrate of the transistor Pa, that is, the potential of the n-type well is fixed to its source potential VA (the substrate of the transistor Pa is not common to other elements). In consequence, the potentials of the n-type well and the source are the same at all times whereby the transistor Pa is free from the back gate bias.

However, the potential of the substrate of the transistor Na can not be fixed to its source potential because the substrate of the transistor Na is common to other elements.

Therefore, the potential of the substrate of the transistor Na is fixed to VB2.

In the present embodiment, in order to prevent the transistor Na from being subjected to the back gate bias, an additional OR gate is disposed between the transistors Pa, Na and an exclusive OR gate receiving the data signal i and frame signal S.

The OR gate receives an output of the exclusive OR gate at one input thereof, and a discharge signal T at the other input thereof.

In this embodiment, the back plate signal output circuit is also provided with the discharge signal T for phase-matching between the back plate signal and the segment signal.

Figure 7:
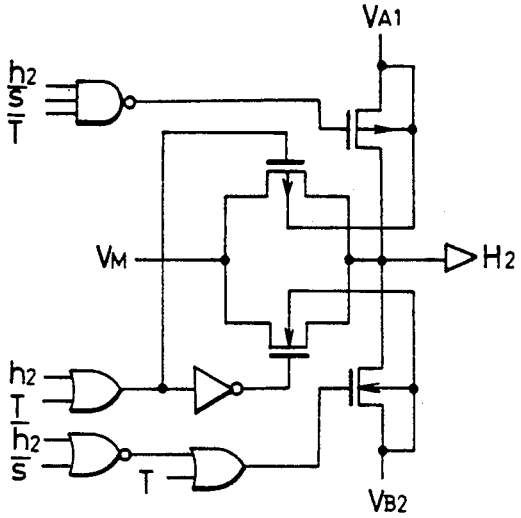
FIG. 7 is a circuit diagram of a back plate signal output circuit of the device of the embodiment according to the present invention.
Figure 8:
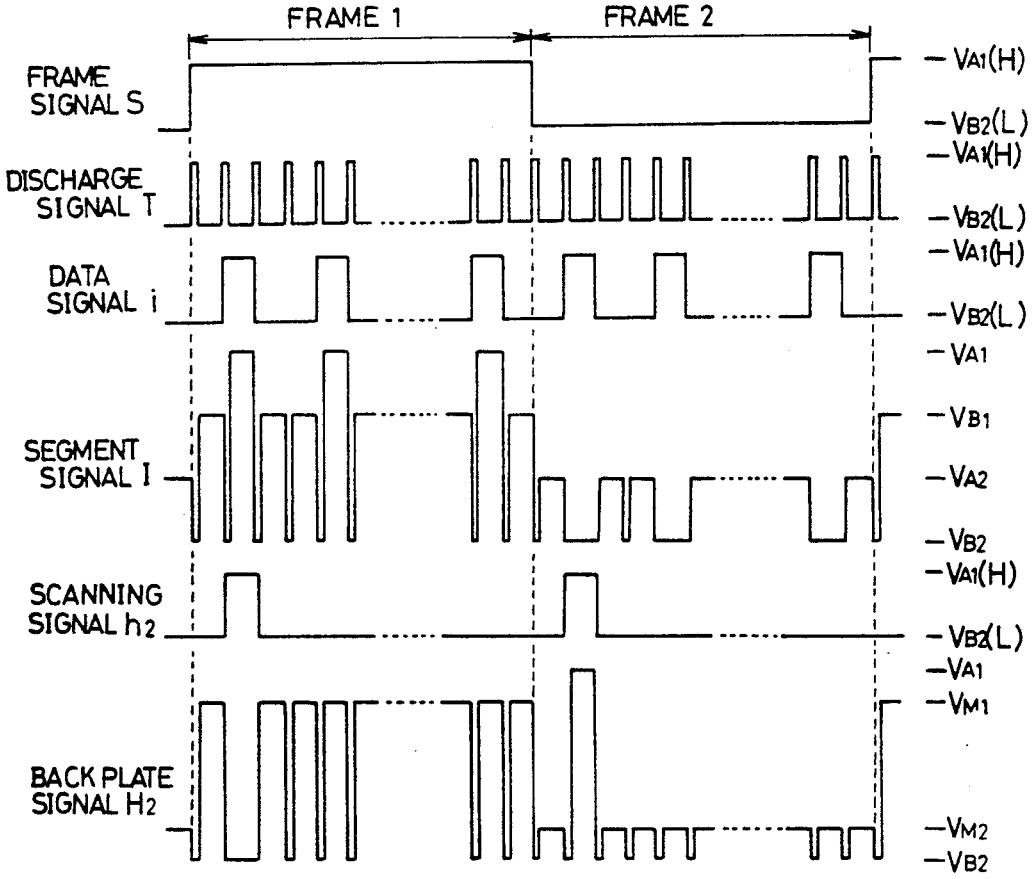
FIG. 8 is a time table showing various signals supplied to the circuits of FIGS. 6 and 7.

These circuits of FIGS. 6 and 7 are supplied with a frame signal S, a data signal i, and a scanning signal h2 shown in a time table of FIG. 8 as well as a negation $\overline{S}$ of the frame signal S, a negation $\overline{h2}$ of the scanning signal h2, and a voltage VM.

As shown in FIG. 6, the potential of the source of the transistor Pa equals to VA, and the potential of the source of the transistor Na equals to VB.

The potential VA is kept at VA1 during FRAME 1, that is, during the frame signal S is at the high level of VA1, and kept at VA2 during FRAME 2, that is, during the frame signal S is at the low level of VB2.

The potential VB is kept at VB1 during FRAME 1, and kept at VB2 during FRAME 2 except that it is shifted to VB2 with priority as long as the discharge signal T is at the high level of VA1.

During FRAME 1, the source potential Vs of the transistor Na is changed from VB1 to VB2 just before the level of the data signal i is changed from the high level of VA1 to the low level of VB2 as the discharge signal T rises to the high level of VA1, and, in the meantime, electric charges charged up in a corresponding liquid crystal cell are discharged in a short period of time through the transistor Na which is not subjected to the back gate bias.

Thereafter, as the discharge signal T returns to the low level of VB2, the source potential VB of the transistor Na is returned to VB1.

Many widely different embodiments of the present invention may be constructed without departing from the spirit and scope of the present invention. It should be understood that the present invention is not limited to the specific embodiment described in this specification, except as defined in the appended claims.

What is claimed is:

1. A device for driving a liquid crystal display device, comprising:

segment signal supplying means for supplying segment signals to segment electrodes of said liquid crystal display device, the level of each of said segment signals being changed according to a level of a corresponding one of data signals received by said segment signal supplying means; and back plate signal supplying means for supplying a back plate signal having a predetermined level to back plate electrodes of said liquid crystal display device in succession;

wherein said segment signal supplying means includes means to shift a level of each of said segment signals, for a short period of time at least shortly prior to a change of level of a corresponding one of said data signals, to such a value that electric charges charged up in a corresponding liquid crystal cell are discharged within said short period of time in order to prevent waveforms of said segment signals from being dulled and wherein said segment signal supplying means further includes an output buffer having a single p-type transistor and a single n-type transistor whose drains are joined together for each segment electrode, said drains being connected to a corresponding electrode.

2. A device according to claim 1, in which said segment signal supplying means further comprises an exclusive OR gate for receiving said data signals and a frame signal, said means to shift a level of each of said segment signals includes an OR gate whose output is connected to the gate electrodes of said p-type and n-type transistors and wherein said OR gate receives the output of said exclusive OR and a discharge signal at the inputs thereof.

3. A device according to claim 1, in which said transistors are CMOS transistors obtained by forming an n-type well in a p-type substrate.

4. A device according to claim 3, in which a potential of said n-type well is fixed to a potential of a source of said p-type transistor.

* * * * *